United States Patent [19]

Betille et al.

[11] Patent Number: 4,747,513

[45] Date of Patent: May 31, 1988

[54] HEAT INSULATING WALL STRUCTURE FOR A FLUID-TIGHT TANK

[75] Inventors: Michel Betille, Montfort L'Amaury; Claude Deliotte, Malakoff, both of France

[73] Assignee: Societe Nouvelle Technigaz, France

[21] Appl. No.: 55,903

[22] Filed: May 29, 1987

[30] Foreign Application Priority Data

Jun. 3, 1986 [FR] France ..... 86 07981

[51] Int. Cl.[4] ..... B63B 23/00

[52] U.S. Cl. ..... 220/452; 220/468; 220/901; 312/214

[58] Field of Search ..... 220/468, 452, 435, 901; 312/214

[56] References Cited

U.S. PATENT DOCUMENTS

| | | | |
|---|---|---|---|
| 2,181,074 | 11/1939 | Scott | 220/452 X |
| 3,339,780 | 9/1967 | Forman et al. | 220/452 X |
| 3,341,050 | 9/1967 | Forman et al. | 220/452 |
| 3,341,051 | 9/1967 | Forman et al. | 220/452 X |
| 3,489,311 | 1/1970 | Folkerts et al. | 220/452 |
| 4,050,609 | 9/1977 | Okamoto et al. | 220/9 LG |
| 4,107,833 | 8/1978 | Knight et al. | 312/214 X |
| 4,190,305 | 2/1980 | Knight et al. | 220/452 X |

*Primary Examiner*—Steven M. Pollard

*Attorney, Agent, or Firm*—Steinberg & Raskin

[57] ABSTRACT

A device forming a heat insulating wall structure for a fluid-tight tank and comprising an interposed joint packing including on each one of its sides at least one lateral joint consisting of a flexible and expansible heat insulating material accommodated within a corresponding recess of the packing body and connected to the latter, which joint after said packing has been mounted between two adjacent panels is in free pressed bearing engagement with the neighbouring panel.

9 Claims, 1 Drawing Sheet

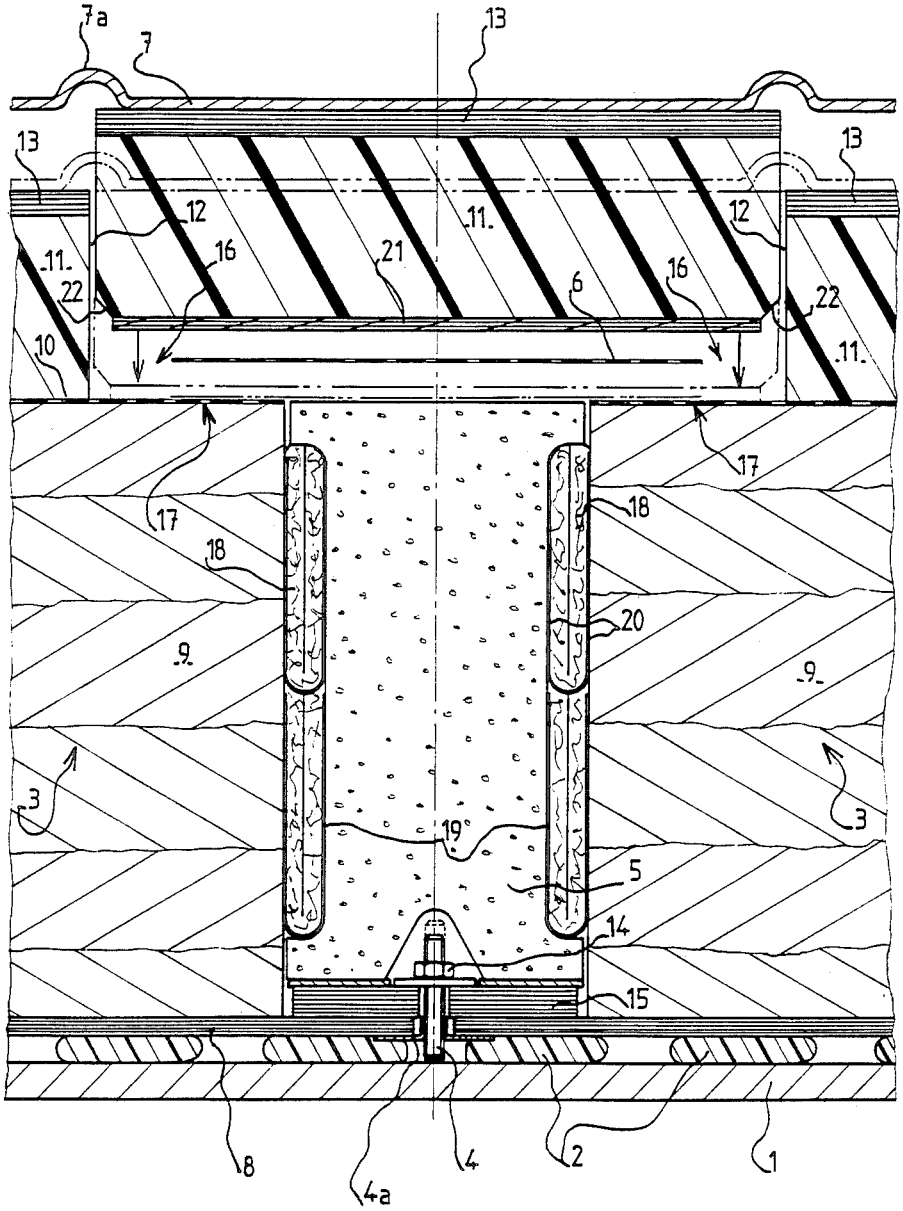
7a
7
13
13
13
12
11
12
11
16
21
16
22
6
22
10
11
17
17
18
18
20
9
9
3
3
19
5
14
15
8
4a
4
2
1

HEAT INSULATING WALL STRUCTURE FOR A FLUID-TIGHT TANK

The present invention relates to a device forming a heat insulating wall structure of an enclosed container space or confining vat constituting a tight heat insulated tank for the storage or preservation of a very cold fluid such in particular as liquefied natural gas.

In the prior state of the art disclosed by the French patent publication No. 2,271,497 and its first certificate of addition publication No. 2,286,341 in the name of the assignee, are already known tanks for the storage or transport or carriage of liquid and/or gaseous fluids a major portion of which is in a liquid phase, such for instance as cryogenic fluids such in particular as liquefied natural gases and in particular methane. These tanks comprise an outer self-supporting or rigid wall, a substantially flexible or yielding membrane-like inner impervious wall or primary barrier spaced from the outer wall and an intermediate heat insulating material secured to the outer wall and serving as a bearing surface for the inner wall, and essentially comprising a layer consisting of adjacent panels separated from each other by interposed gas-tight sealing joints.

The interposed sealing joint is sidewise adhesively bonded or stuck between two prefabricated insulating panels and consists of a resilient material such as flexible poly(vinyl chloride) foam.

This known wall structure however exhibits the inconvenience of causing a delay in the detection of a fluid leak in particular through the impervious secondary barrier forming part of the structure and one portion of which is integrated through adhesives bonding or sticking to the interposed sealing joint, which delay is due to the gas tightness of the insulating foam used (cellular insulation with closed polyurethane cells for instance).

An object of the present invention is mainly to remove the above drawback by providing an improved new construction. For that purpose, with a view to solve the technical problem set, the invention proposes a device which is characterized in that each interposed sealing joint comprises on each one of its sides at least one lateral joint or packing consisting of an expansible flexible heat insulating material accommodated within a corresponding recess of the sealing joint body and connected thereto, the said lateral joint or packing, after the sealing joint has been mounted between two adjacent panels, freely bearing in pressed relationship against the neighbouring panel thereby moreover facilitating the mounting upon taking into account the tolerances for positioning of the adjacent panels.

According to another characterizing feature of the device of the invention intended in particular for a very cold fluid such in particular as liquefied natural gas, the lateral joint consists of a glass wool pad lined externally, except for its end face facing the primary barrier, with a sheet of material which is impervious to the cold liquid, pervious to the gas and has good properties of cryogenic behaviour and transversely folded in a U-shape.

According to a further characterizing feature of the invention, the aforesaid sheet is made from Kraft paper or an equivalent material.

According to still another characterizing feature of the invention, the device preferably comprises at least two superposed pads.

Still according to a further characterizing feature of the invention, the lateral joint is connected through adhesive bonding or sticking to the sealing joint body.

The invention will be better understood and further objects, characterizing features, details and advantages thereof will appear more clearly from the following explanatory description with reference to the diagrammatic accompanying drawing given by way of non-limiting example only and illustrating an embodiment of the invention and wherein the single FIGURE shows a fragmentary sectional view of a portion of the heat insulating wall structure according to the invention.

According to the exemplary embodiment shown on the FIGURE and such as applied to a tank integrated into the hull or hold of tanker ship for instance for transporting liquefied natural gas, the tight heat insulating wall structure of such a tank successively comprises from the outside to the inside:

an outer self-supporting or rigid in particular metal wall 1 consisting for instance of the double steel hull of a ship;

an outer end layer 2 comprising a chequer work pattern of strips or patches of mastic of equivalent cement material along spaced patchwork lines providing the connection between the elements 1 and 8;

an intermediate layer 3 from a heat insulating material consisting of spaced sandwich panels separated from one another and fastened to the outer wall 1 at discrete points by studs 4 advantageously welded to the outer wall 1, the gaps between adjacent panels being filled with interposed sealing or packing joints 5 consisting for instance of a rigid insulating cellular material such as polyurethane foam with closed cells and covered inside with butt-strips 6;

a fluid-tight primary barrier 7 supported or borne by the inner face of the intermediate layer 3 and consisting advantageously of a thin corrugated, creased or fluted, goffered, chequered or ribbed metal sheet or stainless steel for instance with at least one series or row of spaced, substantially parallel corrugations raised or projecting from the inside only.

Each sandwich panel 3 consists advantageously from the ouside towards the inside: of an outer plywood plate 8; of an intermediate plate of insulating material 9 made from polyurethane foam for instance with superposed layers or laminations of a thickness substantially greater than that of the outer plate 8; of an inner plate 10 which together with the butt-strips 6 serve as a fluid-tight secondary barrier; of an inner heat insulating end layer 11 forming a separating layer between both spaced fluid-tight barriers, i.e. the secondary barrier 6, 10 and the primary barrier 7 and constituted by not closely juxtaposed aligned elements 11 forming blocks with opposite sides or edges respectively parallel to the respective directions of the waves or corrugations 7*a* of the primary barrier 7, the blocks 11 being spaced from each other and of such a size that each separating gap 12 between two adjacent blocks be located substantially at a wave or corrugation 7*a* of the primary barrier and extend along the same; of a relatively stiff distributing layer 13 constituted by plates for instance of plywood or suitable synthetic material and interposed between the separating layer 11 and the primary barrier 7.

The splitting up of the inner end layer 11 through dividing up allows the same to more easily follow the thermal expansions and contractions not only of itself but also of the primary barrier 7 thereby reducing the inner residual stresses of thermal origin. This inner end layer 11 is made from a cellular in particular expanded or foam synthetic material such as polyurethane for instance which is relatively flexible especially with respect to the relatively stiffer distributing layer 13 which advantageously is discontinuous by being broken off at each gap 12, respectively, between the blocks 11 so as to not interfere by their relative stiffness with the aforesaid thermal deformations while allowing to follow the same. The distributing layer 13 is assembled or fitted to the various component elements of the inner end layer 11 in particular through adhesive bonding or gluing during the prefabrication of these elements separately.

Each panel stud 4 retains the corresponding sandwich panel 3 through its clamping nut 14 applied against the inner face of the outer plywood plate 8 through the agency of a plate 15 also made from plywood and by being screwed down a recess of the corresponding packing body 5. The stud 4 tightly clamps the plate 15 and one portion of the plate 8 between the nut 14 and a metal support **4*a* screwed onto the stud underneath the plate 8**.

The various component plates and layers of the sandwich panels 3 are all adhesively bonded, stuck or glued to each other at the time of the prefabrication thereof, the outer plywood plate being then stuck or glued to the mastic compound strips 2 after the fastening of the sandwich panels 3 to the outer wall 1.

The inner plate 10 and the butt-strips 6 consist of a laminated material with three joined layers disclosed in detail in particular in the French patent publication No. 2,302,482 applied for in the name of the assignee. The secondary bartier comprising the outer plate 10 is embedded into the sandwich panel 3 so as to be spaced from the bearing face of the primary barrier 7.

Each sandwich panel 3 comprises along each edge adjacent to a neighbouring sandwich panel a rabbet 16 providing a shoulder or step 17 leaving uncovered a corresponding marginal strip of the secondary barrier 10. The barrier butt-strip 6 straddles the confronting shoulders or steps 17 of both neighbouring sandwich panels 3 and is secured in fluid-tight relationship for instance through adhesive bonding, sticking or gluing to the shoulders while covering the joint packing 5 to provide the continuity of the secondary barrier. The block 11 lying above the corresponding joint packing 5 fills up the cavity defined by the corresponding rabbets 16 of both neighbouring sandwich panels 3 (as shown in chain-dotted lines on the drawing) so as to restaure the continuity of the bearing face of the primary barrier 7. In order that some peculiarities of the device of the invention be better understood, this block 11 is shown on the drawing as being partially recessed from its housing cavity, it being understood that this block is in fact fully accommodated in this cavity to provide the aforesaid continuity of the bearing face of the primary barrier.

According to the invention, each interposed joint packing 5 is mounted into the gap between two adjacent intermediate layers 9 and is adhesively bonded or glued once mounted with its opposite upper and lower end faces, respectively, to the plate 15 and to the butt-strip 6 but no adhesive lateral connection of the packing to the longitudinal edges of the intermediate layers 9 is provided. It should be pointed out that the bonded or stuck connection of the lower face of the packing body 5 is carried out with a thick adhesive or glue of the filler-containing resin type thereby allowing during the prefabrication to stick the body to the bottom or end wall of its housing between two adjacent panels 9 whereas the top end face of this body when the latter is finally mounted would be a level or flush with the inner flat faces of the intermediate layers 9.

Each interposed joint packing 5 comprises on each one of its sides facing the longitudinal edges of the intermediate layers 9 at least one lateral joint 18 consisting of a compressed or extensible yielding insulating material accommodated in a corresponding recess 19 of the joint packing body 5. Each lateral joint 18 is connected for instance through adhesive bonding to the packing body during the prefabrication process. In the mounted position, shown on the drawing, of the joint packing 5 between two adjacent intermediate layers 9 each lateral joint 18 is in free pressed bearing engagement with the neighbouring intermediate layer.

Each lateral joint 18 consists advantageously of a glass whool pad lined or covered outside except for its end face turned towards the secondary barrier 6, 10 with a sheet 20 of a material impervious to the cold liquid and pervious to gas and having good properties of cryogenic behaviour. This impervious sheet of material may for instance be a sheet of Kraft paper each pad being thus constituted by a glass wool strip lined on its face with Kraft paper and transversely folded back in U-shape. Each pad 18 would act as a gutter or trough to retain the liquid leaking through the secondary barrier but would allow owing to the porosity previous to gas, the balance of the gaseous pressures within the lateral joint, a quick and easy detection of the leaks as well as a degasing of the structure either through a simple scavenging thereof with an inert gas or by performing alternate cycles of evacuations followed by injections of inert gas. Preferably at least two such overlying pads are provided on either side of the interposed joint packing 5 within their corresponding recess 19.

The inner block 11 stuck to the butt-joint strip 6 is covered or lined on its outer face adjacent to the secondary barrier 6, 10 with a glass fiber web or fabric 21 glued onto the said outer face to reinforce the mechanical strength of the block which has to provide the continuity between both adjacent sandwich panels 3. The block 11 is stuck to the bottom or end wall of its housing cavity 16 formed by the shoulders 17 and the inner end face of the joint packing. Advantageously, the butt-strip block 11 is chamfered or bevelled bilaterally along both of its longitudinal outer edge lines as shown by the reference numeral 22 for providing a space for discharging the excess adhesive so as to avoid inner stresses likely to result in an incipient cracking.

What is claimed is:

1. A device forming a heat insulating wall structure of a fluid-tight heat-insulated tank, of the kind comprising an outer self-supporting or rigid wall; a substantially flexible or yielding membrane-like impervious inner wall or primary barrier spaced from said outer wall and a heat insulating intermediate material, and secured to the outer wall and serving as a bearing surface for said inner wall and essentially including a layer consisting of adjacent panels separated from each other by interposed gas-tight joint packings, wherein the improvement consists in that each interposed joint packing comprises on each of its sides at least one lateral joint consisting of a flexible expansible heat insulating material accommodated in a corresponding recess of the packing body and connected thereto, said lateral joint, after said packing having been mounted between two adjacent panels, being in free pressed bearing engagement with the neighbouring panel.

2. A device according to claim 1, intended in particular for containing a very cold fluid such in particular as liquified natural gas and wherein said lateral joint consists of a glass wool pad externally lined except for its end face turned towards the primary barrier with a sheet of material impervious to the cold liquid, previous to gas and having good properties of cryogenic behaviour and folded transversely back in U-shape.

3. A device according to claim 2, wherein said sheet is made from Kraft paper.

4. A device according to claim 2, comprising at least two overlying pads.

5. A device according to claim 1, wherein said lateral joint is connected through adhesive bonding to said interposed joint packing body.

6. A device according to claim 1, wherein said interposed joint packing is made from a rigid insulating cellular material such as a polyurethane foam with closed cells.

7. A device according to claim 1, wherein said packing body is stuck to the bottom of its housing recess between two panels.

8. A device according to claim 1, wherein each panel comprises a fluid-tight layer forming a secondary barrier embedded within said panel so as to be spaced from the bearing face of the primary barrier and a rabbet formed along said adjacent edge of a neighbouring panel and providing a shoulder leaving uncovered a corresponding marginal strip of said secondary barrier, a barrier butt-strip straddling the confronting shoulders of any two neighbouring panels and tightly secured as through adhesive bonding to said shoulders while covering the joint packing for providing the continuity of the secondary barrier and a block of heat insulating material filling up the cavity defined by the corresponding rabbets of any two neighbouring panels thereby restoring the continuity of the bearing face of the primary barrier, wherein the improvement consists in that said block is lined on its end face adjacent to said butt-strip with a glass fiber fabric and is glued to the bottom wall of its housing recess.

9. A device according to claim 8, wherein said block comprises two chamfers for discharging the excess adhesive along its two longitudinal edge lines.

* * * * *